US007240980B2

(12) United States Patent
Koons

(10) Patent No.: US 7,240,980 B2
(45) **Date of Patent: *Jul. 10, 2007**

(54) FREEZER DRAWER SUPPORT ASSEMBLY

(75) Inventor: Bill J. Koons, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/249,375

(22) Filed: Oct. 14, 2005

(65) Prior Publication Data

US 2006/0033410 A1 Feb. 16, 2006

Related U.S. Application Data

(63) Continuation of application No. 10/379,584, filed on Mar. 6, 2003, now Pat. No. 6,971,730.

(60) Provisional application No. 60/364,108, filed on Mar. 15, 2002.

(51) Int. Cl.
*A47B 96/04* (2006.01)

(52) U.S. Cl. ..... 312/404; 312/402; 312/334.8

(58) Field of Classification Search ..... 312/401, 312/402, 404, 405, 405.1, 408, 321.5, 330.1, 312/334.8, 333; 62/382, 440
See application file for complete search history.

(56) References Cited

U.S. PATENT DOCUMENTS

| | | | | |
|---|---|---|---|---|
| 2,682,754 | A | | 7/1954 | Eck |
| 2,711,944 | A | | 6/1955 | Meek et al. |
| 4,173,378 | A | | 11/1979 | Hanson et al. |
| 4,751,826 | A | | 6/1988 | Kawahara et al. |
| 5,040,856 | A | | 8/1991 | Wilkins et al. |
| 5,366,284 | A | | 11/1994 | Baker et al. |
| 5,692,817 | A | | 12/1997 | Jun et al. |
| 5,758,512 | A | | 6/1998 | Peterson et al. |
| 5,893,620 | A | | 4/1999 | Birgelis |
| 5,980,007 | A | * | 11/1999 | Singh ..... 312/334.1 |
| 5,980,009 | A | * | 11/1999 | Atalla et al. ..... 312/408 |
| 6,123,402 | A | | 9/2000 | Bowyer et al. |
| 6,209,979 | B1 | | 4/2001 | Fall et al. |
| 6,447,083 | B1 | | 9/2002 | Chiapetta et al. |
| 6,641,239 | B2 | | 11/2003 | Kaiser |
| 2001/0054296 | A1 | * | 12/2001 | Kaiser ..... 62/373 |

FOREIGN PATENT DOCUMENTS

| | | |
|---|---|---|
| CA | 2300791 | 9/2001 |
| JP | 8-240378 | 9/1996 |

* cited by examiner

*Primary Examiner*—James O. Hansen
(74) *Attorney, Agent, or Firm*—Kirk Goodwin; Michael D. Lafrenz; John F. Colligan

(57) ABSTRACT

A freezer drawer support assembly is provided for a refrigerator including an upper fresh food compartment and a lower freezer compartment having a rearwardly tapering liner. The support assembly includes a pair of side adapters which compensate for the tapering of the liner, while defining both channels for the attachment of extensible drawer slides, to which a freezer door and a slidable basket is attached, and ledges for slidably supporting another basket. Preferably, the side adapters mate with groove and ledge structure formed into the liner to enhance the transfer of weight from the baskets, while enabling a refrigerator liner designed to directly support one or more slidable baskets to indirectly support multiple baskets which can be slid relative to each other.

20 Claims, 5 Drawing Sheets

FREEZER DRAWER SUPPORT ASSEMBLY

CROSS-REFERENCE TO RELATED APPLICATIONS

This application represents a continuation of U.S. patent application Ser. No. 10/379,584 filed Mar. 6, 2003 now U.S. Pat. No. 6,971,730 which claims the benefit to U.S. Provisional Application No. 60/364,108 filed on Mar. 15, 2002.

BACKGROUND OF THE INVENTION

1. Field of the Invention

The present invention pertains to the art of refrigerators and, more particularly, to a support arrangement for a pull-out freezer drawer.

2. Discussion of the Prior Art

There exist various styles of refrigerators on the market. Most common are side-by-side, top mount, and bottom mount models. In a side-by-side model, fresh food and freezer compartments are arranged laterally adjacent one another. A top mount refrigerator includes an upper freezer compartment and a lower fresh food compartment. Finally, bottom mount models have the fresh food compartment located above the freezer compartment.

In bottom mount models, it is known to employ both pivoting freezer doors and freezer doors which slide between open and closed positions. In a bottom mount style refrigerator including either a pivoting or sliding door, it is known to employ one or more sliding baskets to store food items within the freezer compartment. More specifically, in connection with a bottom mount refrigerator including a pivoting freezer door, it is known to thermoform a freezer compartment defining liner with integral side rails upon which one or more baskets can be directly slidably supported. In bottom mount refrigerators employing sliding doors, it is common to mount elongated support members to the opposing side walls of the freezer compartment through the use of mechanical fasteners, and then to support one or more baskets, either directly or indirectly, upon the support members. Typically, in this case, at least the support for one of the baskets is also connected to the door such that, as the door is slid relative to a cabinet of the refrigerator, the basket shifts into and out of the freezer compartment. Most commonly, these types of bottom mount refrigerators employ metal liners into which mechanical fasteners in the form of screws are secured to attach the support members.

Given construction and assembly variations between these different types of bottom mount refrigerators, completely different liners are required depending on whether a pivoting or sliding door arrangement is desired. Therefore, it is not possible to simply change a bottom mount refrigerator designed for use with a pivoting door to employ a sliding door arrangement. Based thereon, it would be beneficial to provide a supplemental adapter assembly which would enable a bottom mount refrigerator cabinet to be used with either pivoting or sliding doors and their associated basket arrangements.

SUMMARY OF THE INVENTION

The present invention is directed to a support assembly which is adapted to be fitted between rail structure formed in a thermoformed or injection molded freezer compartment liner of a bottom mount refrigerator in order to enable the refrigerator to be used with a slidably mounted freezer door/storage drawer combination. More specifically, a freezer compartment liner, formed with integral side rail structure that can directly, slidably support storage drawers or baskets, is adapted to receive side support adapters that enable the liner to be used in combination with a slidable freezer door which is interconnected to extensible slide structure for one or more drawers or baskets.

In accordance with the most preferred embodiment of the invention, each side support adapter includes upper and lower basket support structure. The lower basket support structure defines a channel which is adapted to snap-fittingly receive a drawer support slide member that is indirectly attached to a slidable freezer door of the refrigerator. The upper basket support structure is defined by a ledge on each of the side adapters which provides a support surface for an upper basket to slide independently of the lower basket. Projecting from a rear of each side support adapter are multiple lugs which are received within grooves or recesses defined in the liner and rest on substantially horizontal ledge portions through which vertical loads are transferred to the overall cabinet of the refrigerator. Each side adapter is preferably tapered from front to back to offset a tapering of the thermoformed or injection molded liner. In this manner, the opposing side adapters extend substantially parallel to each other. Mechanical fasteners are used to secure the side support adapters in place.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
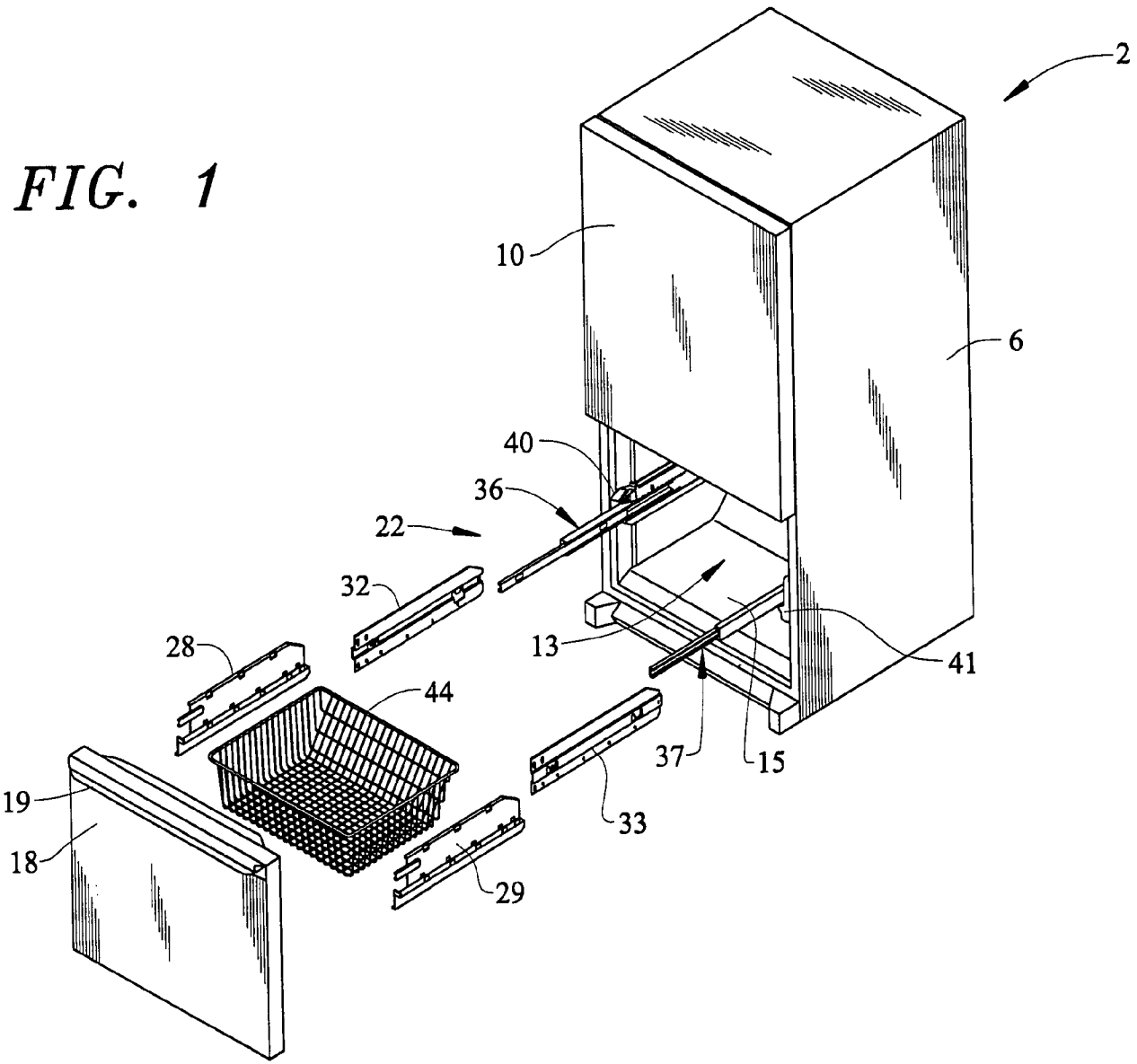
FIG. 1 is a partial exploded view of a bottom mount style refrigerator incorporating the freezer drawer support assembly of the invention.

With initial reference to FIG. 1, a refrigerator incorporating the invention is generally indicated at 2. Refrigerator 2 includes a cabinet shell 6 to which is attached a fresh food compartment door 10. At this point, it should be readily recognized that refrigerator 2 constitutes a bottom mount style refrigerator wherein fresh food compartment door 10 is adapted to seal off an upper fresh food compartment defined within cabinet shell 6. In a manner known in the art, fresh food compartment door 10 is preferably, pivotally mounted about a vertical axis to cabinet shell 6 through upper and lower hinges (not shown). Refrigerator 2 also includes a lower freezer compartment 13 which is defined by a liner 15. Freezer compartment 13 is adapted to be sealed by means of a freezer door 18 having an associated handle 19. In accordance with the present invention, freezer door 18 is adapted to slide towards and away from cabinet shell 6 through the use of a slide assembly generally indicated at 22 in order to selective access or seal freezer compartment 13.

As shown in this figure, slide assembly 22 generally includes a pair of opposing basket support plates 28 and 29 which are adapted to be fixedly secured to a rear portion of freezer door 18 through suitable brackets and fasteners (not shown). Basket support plates 28 and 29 respectively mate with a pair of door support plates 32 and 33 which, in turn, interconnect basket support plates 28 and 29 to respective extensible drawer slides 36 and 37. As will be detailed more fully below, drawer slides 36 and 37 are interconnected to liner 15 of freezer compartment 13 through respective side adapters 40 and 41. The present invention is particularly concerned with the inclusion, construction, and mounting of each side adapter 40, 41 as will be detailed below. FIG. 1 also illustrates a lower basket 44 which is adapted to be carried by basket support plates 28 and 29 so as to be shiftable into and out of freezer compartment 13 with the movement of freezer door 18.

Figure 2:
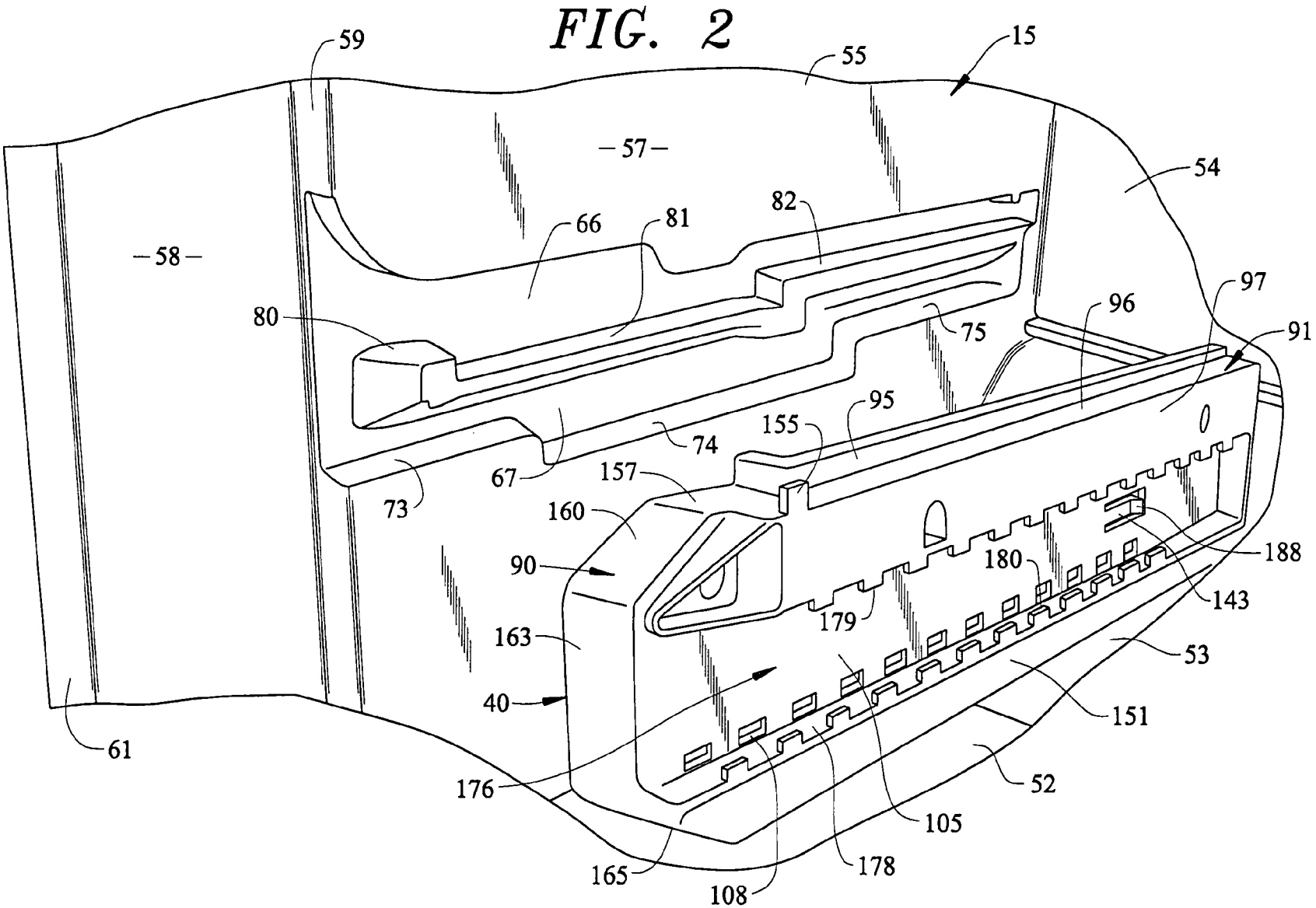
FIG. 2 is an enlarged view of a side wall portion of a liner provided in the refrigerator of FIG. 1, with a side adapter of the freezer drawer support assembly shown adjacent thereto prior to mounting.

FIG. 2 illustrates details of liner 15 and side adapter 40. In general, liner 15 includes a flat bottom portion 52, an inclined bottom portion 53, a rear wall 54, and opposing side walls 55. Each side wall 55 is shown to include an aft section 57 and a frontal section 58. In the preferred embodiment shown, aft and frontal sections 57 and 58 extend in different planes and are interconnected by an offset section 59. In any event, frontal section 58 leads to a frontal edge generally indicated at 61.

Formed in side wall 55, from offset section 59 to directly adjacent rear wall 54, is an elongated upper groove or recess 66, as well as a lower groove or recess 67. In general, upper and lower grooves 66 and 67 are formed in each side wall 55 in order to enable upper and lower baskets (not shown) to be slideably mounted within liner 15 when refrigerator 2 is utilized in combination with a pivoting freezer door. In accordance with the present invention, side adapters 40 and 41 are provided to mate with the structure of upper and lower grooves 66 and 67 in order to enable liner 15 to be utilized in connection with slideable freezer door 18 and slide assembly 22.

Based on the above, it should be recognized that, although the actual configuration of upper and lower grooves 66 and 67 can take various forms, the preferred form shown in FIG. 2 is known in the art for use in connection with a bottom mount refrigerator employing a pivotable freezer door and upper and lower freezer baskets. In any event, the actual configuration shown for upper and lower grooves 66 and 67 are perhaps best defined by the supporting structure associated therewith. Therefore, due to the inclusion of lower groove 67, side wall 55 is formed with a lower frontal ledge portion 73, an intermediate, lower ledge portion 74, and a lower, rear ledge portion 75. In addition, due to the presence of upper groove 66, side wall 55 defines an upper frontal ledge portion 80, an upper intermediate ledge portion 81, and an upper, rear ledge portion 82. Again, this structure enables an upper rim of a lower basket, and a lower rim of an upper basket to extend between the side walls 55 of liner 15 and be slideably mounted for movement into and out of freezer compartment 13. However, in accordance with the present invention, side adapters 40 and 41 are mounted utilizing the existing structure of side walls 55 to accommodate the overall slide assembly 22 in accordance with the invention.

Figure 3:
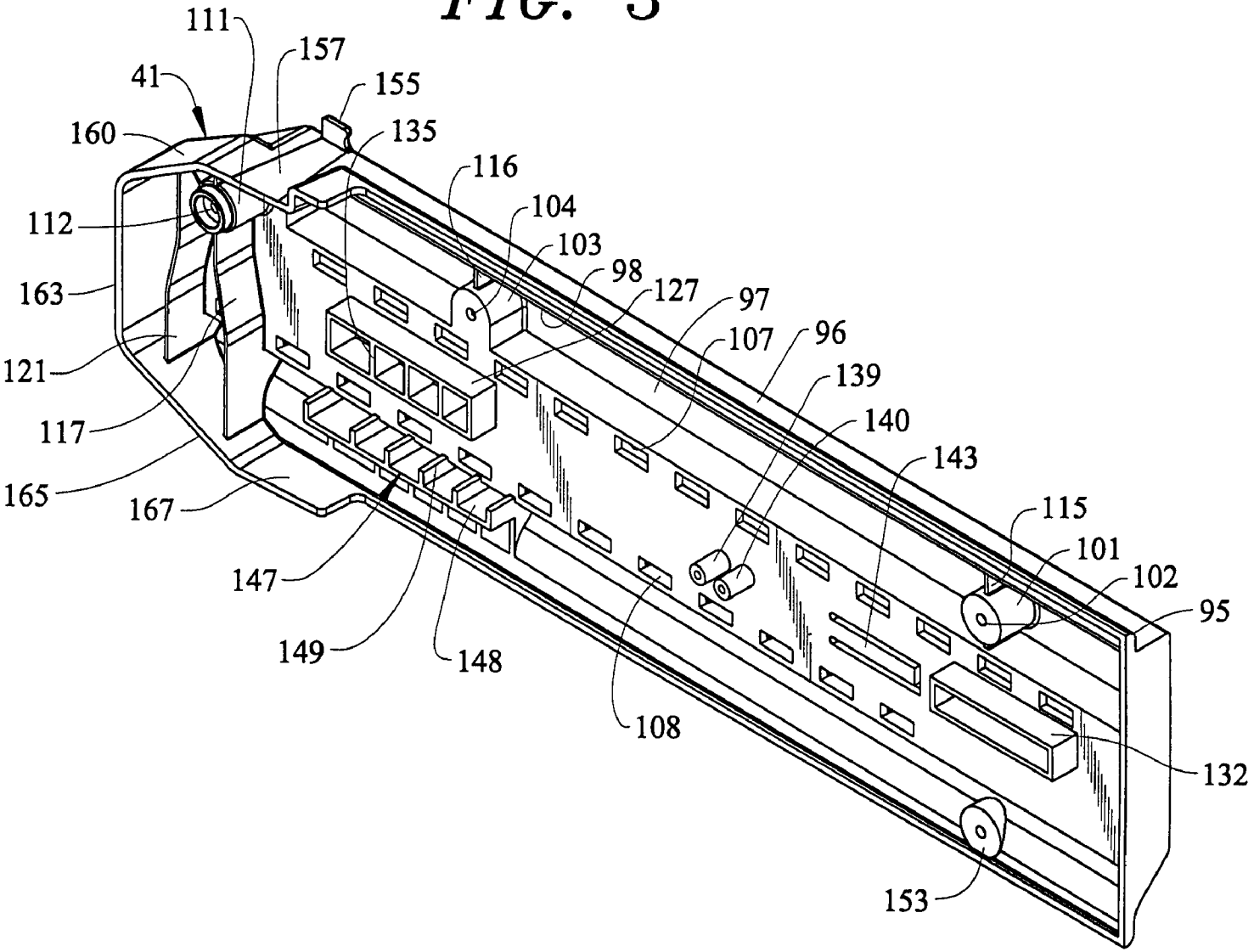
FIG. 3 is a rear view of the side adapter of the freezer drawer support assembly of the invention.
Figure 4:
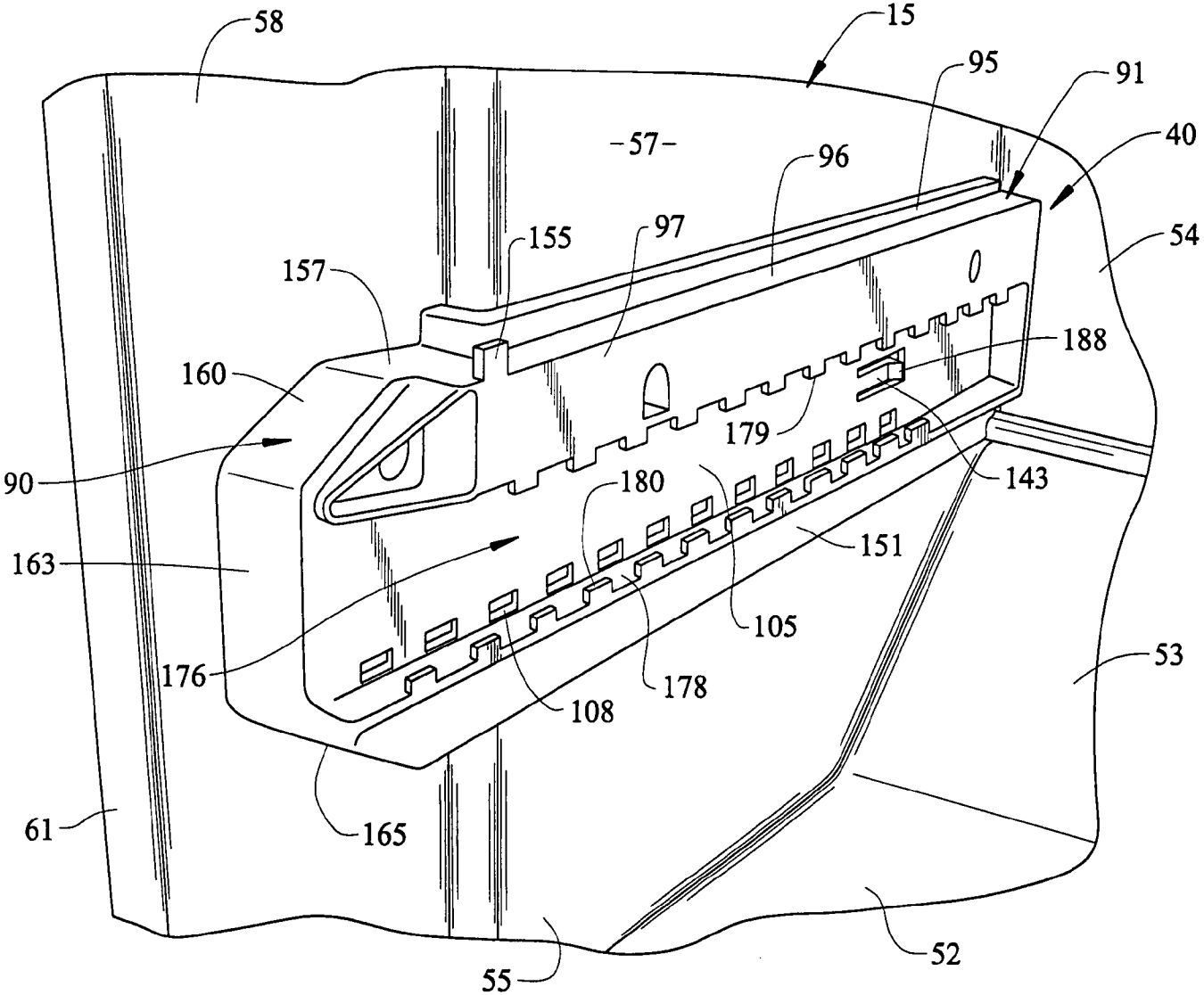
FIG. 4 is a partial view of the side wall portion of FIG. 2, with the side adapter of the freezer drawer support assembly of the invention secured thereto.

Reference will now be made to FIGS. 2-4 in describing the construction of each side adapter 40, 41 of the present invention. At this initial stage, it should be noted that side adapters 40 and 41 are essentially mirror images of one another, such that the common structure will be described with respect to side adapter 40 shown in FIGS. 2 and 4 and side adapter 41 as shown in FIG. 3. In general, each side adapter 40, 41 includes a frontal section 90 and a rear section 91. As it is important to enable freezer door 18 to shift straight away from cabinet shell 6 and return to a position which establishes a proper seal, each side adapter 40, 41 is specifically constructed to accommodate for any divergence between side walls 55 of liner 15 in order that side adapters 40 and 41 define parallel paths for extensible drawer slides 36 and 37. Therefore, in accordance with the most preferred form of the invention, each side adapter 40, 41 slightly tapers from frontal section 90 to rear section 91 as indicated in these figures.

In any event, each side adapter 40, 41 is shown to include an upstanding wall 95 which follows the contour of side wall 55 from offset section 59 through aft section 57, with upstanding wall 95 leading to an upper ledge 96. In turn, upper ledge 96 leads to an upper wall 97 behind which is defined an elongated recess indicated at 98 in FIG. 3. Preferably defined within recess 98 is a first boss 101 provided with a hole 102, as well as a second boss 103 provided with a corresponding hole 104. Below upper wall 97 is provided a recessed, intermediate wall 105 that is shown to include an upper row of slots 107 and a lower row of slots 108. Located forward of recess 98 is a third boss 111 having an associated hole 112. As will be detailed more fully below, first, second and third bosses 101, 103 and 111 are adapted to receive mechanical fasteners through respective holes 102, 104 and 112 in mounting side adapters 40 and 41 to liner 15. For reinforcement purposes, a plurality of ribs, such as those indicated at 115-117 are provided as structural reinforcements around bosses 101, 103 and 111 respectively. An additional structural reinforcement 121 is preferably provided forward of third boss 111 as well.

In the most preferred form of the invention, each side adapter 40, 41 is injection molded of plastic. Most preferably, when forming each side adapter 40, 41, intermediate wall 105 is integrally formed with an upper frontal lug 127 and a rear lug 132. In the most preferred form of the invention, each of upper frontal lug 127 and rear 132 is generally boxed-shaped, with at least upper frontal lug 127 being provided with various cross supports 135. Also formed along intermediate wall 105 is a pair of central bosses 139 and 140, as well as a cantilevered member 143.

Below intermediate wall 105, and preferably beneath upper frontal lug 127, is a lower frontal lug 147. In accordance with the embodiment shown, lower frontal lug 147 includes a main plate portion 148 from which extend a plurality of ribs 149. Also arranged below intermediate wall 105 is a lower wall 151 which is shown to be formed with a fourth boss 153.

As shown in FIGS. 2-4, upper ledge 96 has projecting therefrom an upstanding stop 155. Upstanding stop 155 is spaced from upstanding wall 95 by upper ledge 96. Adjacent upstanding stop 155, upper ledge 96 leads to a lateral section 157 of a respective side adapter 40, 41. Lateral section 157 forms part of frontal section 90 and leads to a forwardly sloping section 160, a front face section 163, a rearwardly sloping section 165, and a short bottom section 167. With this overall construction, each side adapter 40, 41 defines a channel 176 that extends along intermediate wall 105 and which defines a lower ledge 178. Channel 176 is also defined, at least laterally, by an upper row of teeth members 179 and a lower row of teeth members 180. As clearly shown in these figures, cantilevered member 143 is exposed to channel 176 and is provided at a rear end thereof with a wedge section 188 which projects into channel 176.

During assembly of refrigerator 2, liner 15 is preferably thermoformed with upper and lower grooves 66 and 67. With this construction, liner 15 can be used to directly, slideably support upper and lower freezer baskets when refrigerator 2 is used in combination with a pivoting freezer door. However, in accordance with the present invention wherein freezer door 15 is slideable relative to cabinet shell 6, each side wall 55 has mounted thereon a respective side adapter 40, 41. In mounting each side adapter 40, 41, upper frontal lug 127 is positioned to rest upon upper frontal ledge portion 80, rear lug 132 is positioned upon upper rear ledge portion 82, and lower frontal lug 147 sets upon lower frontal ledge portion 73. The resting of upper frontal lug 127 and lower frontal lug 147 in this manner is seen to be clearly illustrated in FIG. 5.

Due to the construction of each side adapter 40, 41, frontal section 90 is made to conform to frontal section 58, as well as offset section 59, of a respective side wall 55. Correspondingly, rear section 91 conforms to aft section 57 of side wall 55. Once supported in this fashion, mechanical fasteners (not shown) are extended through holes 102, 104 and 112 in bosses 101, 103 and 111 in order to fixedly secure each side adapter 40, 41 to a respective side wall 55. Most preferably, refrigerator 2 is provided with mounting structure, such as in the form of plates, which are arranged behind liner 15 at the location of at least bosses 101, 103 and 111, with this mounting structure being rigidly maintained in a desired position upon the curing of foamed insulation injected between cabinet shell 6 and liner 15 in a manner known in the art. Therefore, the threaded fasteners associated with bosses 101, 103 and 111 extend not only through liner 15 but also into additional mounting structure to secure each side adapter 40, 41 in place. If desired, an additional fastening point can be established at fourth boss 153.

Figure 5:
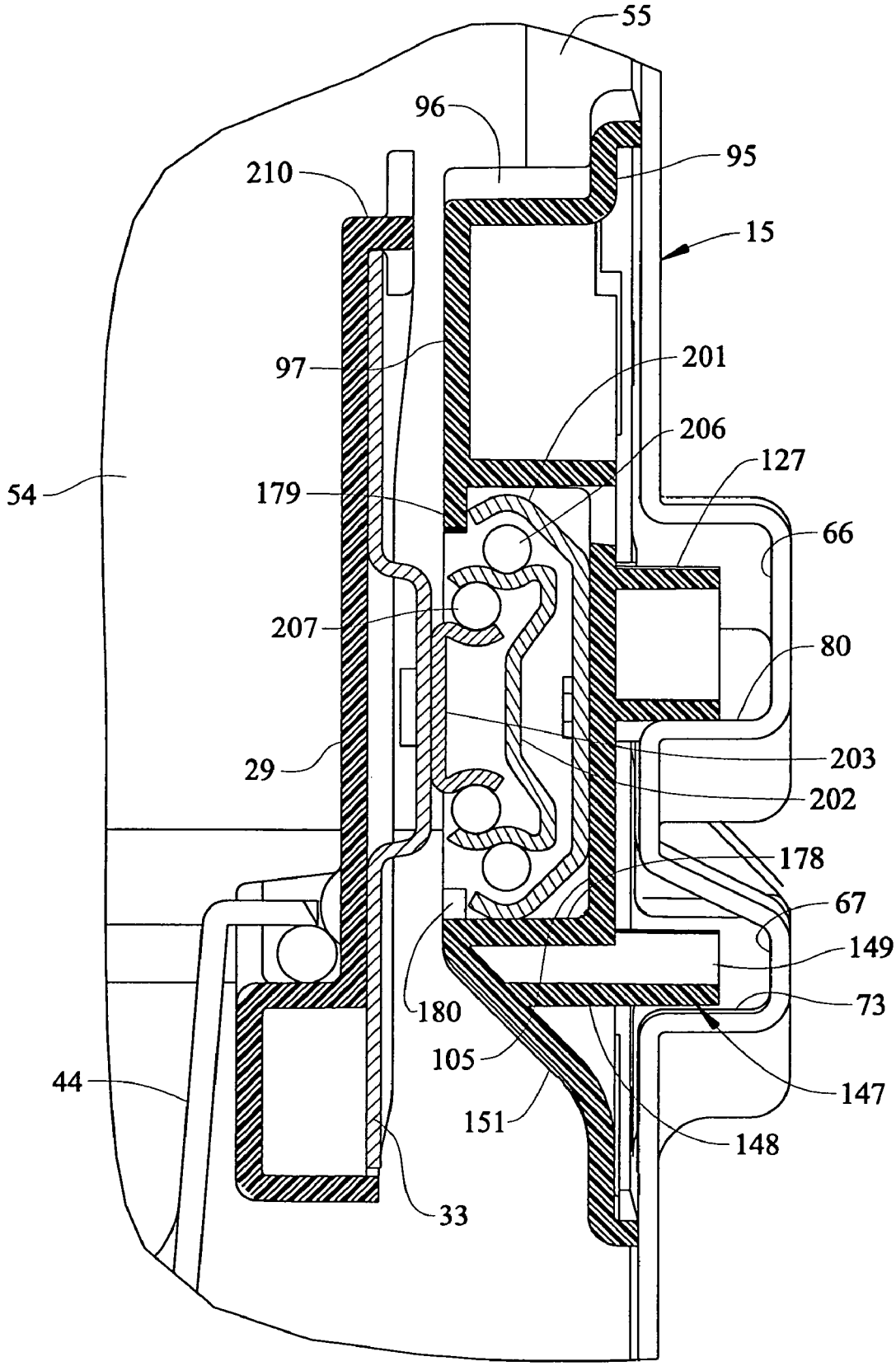
FIG. 5 is a cross-sectional view of the overall drawer support assembly of the invention.

Once side adapters 40 and 41 are mounted in this fashion, each drawer slide 36, 37 can be secured to a respective side adapter 40, 41 within channel 176. More specifically, each drawer slide 36, 37 is slid upon a respective lower ledge 178, between intermediate wall 105 and the upper and lower rows of teeth members 179 and 180. As best shown in FIG. 5, each drawer slide 36, 37 preferably includes an outermost cabinet member 201, an intermediate member 202 and a drawer member 203. Interposed between cabinet member 201 and intermediate member 202 are respective ball bearings 206. Similarly, ball bearings 207 are provided between intermediate member 202 and drawer member 203.

In any event, each drawer slide 36, 37 is adapted to be mounted within a respective channel 176. As cabinet member 201 reaches cantilevered member 143, the abutment with wedge section 188 will cause cantilever member 143 to deflect inward, thereby allowing at least a portion of cabinet member 201 to pass cantilever member 143. Although not shown in these figures, cabinet member 201 preferably includes an aperture which becomes aligned with wedge section 188 upon full insertion of slide assembly 22 within channel 176 such that cantilevered member 143 will be caused to again deflect to the position shown in FIGS. 2 and 4, thereby selectively retaining drawer slide 36, 37 in position. Actually, there is preferably a rather snug fit between drawer member 201 and channel 176 as generally represented in FIG. 5.

As also shown in this figure, drawer member 203 is fixedly secured to a respective door support plate 32, 33 which, in turn, is interconnected to a respective basket support plate 28, 29. Since each basket support plate 28, 29 is secured to freezer door 18, when freezer door 18 is pulled away from cabinet shell 6, basket support plates 28 and 29 and door support plates 32 and 33 will be drawn out of freezer compartment 13 with drawer member 203. Drawer member 203 will be shifted relative to intermediate member 202 due to the arrangement of ball bearings 207. When drawer member 203 reaches a fully extended position, then both drawer member 203 and intermediate member 202 will extend relative to cabinet shell 6 and cabinet member 201. Eventually, extensible drawer slides 36 and 37 will achieve their maximum extended position, at which point at least basket 44 is fully exposed outside of freezer compartment 13.

Based on the above description, it should be readily apparent that the inclusion of side adapters 40 and 41 not only enable the use of a common liner 15 on various model refrigerators, but accommodates the tapering of side walls 55 to assure that extensible drawer slides 36 and 37 will extend parallel to one another. The incorporation, structure and positioning of lugs 127, 132 and 147 enable each side adapter 40, 41 to nest in the existing geometry formed into liner 15 either through a thermoforming or injection molding process. Therefore, lugs 127, 132 and 147 transfer vertical loads directly to the overall foamed refrigerator assembly which is considered to be extremely advantageous, as opposed to hanging side adapters 40, 41 from liner 15 solely through the use of screws and anchors. The inclusion of cantilevered member 143 and wedge section 188 advantageously provides a snap feature for the mounting of a respective drawer slide 36, 37 and prevents the drawer slide 36, 37 from undesirably sliding forward. Upper ledge 96 on each side adapter 40, 41 establishes a setting surface for an upper basket (not shown) which can slide independently of drawer slides 36 and 37. This configuration is considered to allow a greater range of motion for an upper basket. When such an upper basket is employed, it should be noted that the basket can be drawn out to also rest upon an uppermost edge 210 of basket support plates 28 and 29.

Although described with reference to a preferred embodiment of the invention, it should be readily understood that various changes and/or modifications can be made to the invention without departing from the spirit thereof. For instance, it should be readily apparent that side adapters 40 and 41 have been configured based on the preferred construction shown for side walls 55 of liner 15. This configuration is currently used in connection with a freezer compartment 13 of approximately 33 inches wide. On more narrow models wherein only a single basket may be utilized, only a single groove may be provided in the liner. Therefore, the actual configuration of the side adapters and the number of lugs for supporting the same would correspondingly change. Of course, it is also known to produce refrigerator liners with inwardly projecting rails and a side adapter in accordance with the present invention could also be configured for use with this type of arrangement. Regardless, given that the invention is intended for use in connection with a slideable freezer door 18, it is important to maintain the parallel relationship between the respective channels 176 and therefore side adapters 40 and 41 must be constructed in such a manner as to compensate for variations in the lateral dimensions of the freezer liner, such as in cases where the freezer liner tapers from front to rear. In any event, side adapters 40 and 41 can advantageously define support structure for multiple baskets and are integrally formed with lug structure which effectively transfers vertical loading. In general, the invention is only intended to be limited by the scope of the following claims.

I claim:

1. A refrigerator comprising:

an upper fresh food compartment having an associated fresh food compartment door;

a lower freezer compartment having an associated freezer compartment door, said freezer compartment being defined by a liner including opposing side walls having a respective laterally outwardly projecting offset sections;

a freezer drawer support assembly including first and second side adapters, each having a respective front section and a respective channel, and a pair of extensible drawer slides, each of said first and second side adapters being mounted to respective ones of the opposing side walls with a portion of the front section extending forward of and about the offset section, said pair of extensible drawer slides being mounted in the channels of the first and second side adapters, said freezer door being connected to the extensible drawer slides for fore-to-aft movement in order to selectively provide access to the freezer compartment; and a basket slidably supported by first and second side adapters.

2. The refrigerator according to claim 1, wherein each of the opposing side walls of the liner includes at least one groove defining a ledge portion and each of said first and second side adapters is provided with a plurality of lugs extending from a rear section thereof, said plurality of lugs extending into the at least one groove and nesting with the ledge portion.

3. The refrigerator according to claim 1, wherein each of the first and second side adapters includes a plurality of bosses which receive mechanical fasteners for fixing each of the first and second side adapters to the liner.

4. The refrigerator according to claim 1, wherein each of the first and second side adapters includes an upper wall, a lower wall and an intermediate wall, said intermediate wall being recessed relative to the upper and lower walls so as to define the channel.

5. The refrigerator according to claim 4, further comprising: a plurality of spaced teeth members extending from each of the upper and lower walls, said channel being defined laterally between the intermediate wall and the plurality of spaced teeth members.

6. The refrigerator according to claim 1, further comprising: a member cantilevered from the first side adapter and projecting into the channel for snap-fittingly engaging a respective one of the drawer slides.

7. The refrigerator according to claim 1, wherein the opposing side walls of the liner taper fore-to-aft such that a distance between the opposing side walls at a front portion of the freezer compartment is greater than a distance between the opposing side walls at a rear portion of the freezer compartment.

8. A refrigerator comprising:

an upper fresh food compartment having an associated fresh food compartment door;

a lower freezer compartment having an associated freezer compartment door, said freezer compartment being defined by a liner including opposing side walls; and a freezer drawer support assembly including:

first and second side adapters, each having a front section and a channel, mounted to respective ones of the opposing side walls, each of said first and second side adapters being provided with a cantilevered member located within a respective said channel; and a pair of extensible drawer slides snap-fittingly attached to the cantilevered members in the channels of the first and second side adapters, said freezer compartment door being connected to the extensible drawer slides for fore-to-aft movement relative to the liner in order to selectively provide access to the freezer compartment.

9. The refrigerator according to claim 8, wherein each of the extensible drawer slides includes a cabinet member, an intermediate member and a drawer member which are extensibly interconnected.

10. The refrigerator according to claim 9, further comprising: a wedge section provided on each cantilevered member, said wedge section snap-fittingly engaging the cabinet member to retain a respective one of the extensible drawer slides in a respective channel.

11. The refrigerator according to claim 8, wherein each of the first and second side adapters includes an upper wall, a lower wall and an intermediate wall, said intermediate wall being recessed relative to the upper and lower walls so as to define the channel.

12. The refrigerator according to claim 11, further comprising: a plurality of spaced teeth members extending from each of the upper and lower walls, said channel being defined laterally between the intermediate wall and the plurality of spaced teeth members.

13. The refrigerator according to claim 8, wherein the opposing side walls of the liner taper fore-to-aft such that a distance between the opposing side walls at a front portion of the freezer compartment is greater than a distance between the opposing side walls at a rear portion of the freezer compartment.

14. The refrigerator according to claim 8, further comprising:

a pair of basket support plates fixed to the freezer door; and a basket slidably supported by the pair of basket support plates.

15. In a refrigerator including an upper fresh food compartment having an associated fresh food compartment door and a lower freezer compartment having an associated freezer compartment door, with said freezer compartment being defined by a liner including opposing side walls having a laterally outwardly projecting offset section, a method of mounting a freezer drawer support assembly comprising:

mounting first and second side adapters on respective ones of the opposing side walls, each of said first and second side adapters including a front face section and a channel;

positioning a portion of the front face section of each of the first and second side adapters upon the laterally outwardly projecting offset section to establish a desired parallel alignment of the channels; and attaching first and second extensible drawer slides in the channels of the first and second side adapters, with the freezer compartment door being connected to the pair of extensible drawer slides for sliding movement relative to the liner.

16. The method of claim 15, further comprising: snap-fitting the first and second extensible drawer slides in corresponding ones of the channels of the first and second side adapters.

17. The method of claim 15, wherein the first and second extensible drawer slides are snap-fittingly secured in corresponding ones of the channels of the first and second side adapters through respective cantilevered members.

18. The method of claim 15, further comprising: positioning the first and second extensible drawer slides vertically between upper and lower walls, and laterally between an intermediate wall and a plurality of teeth members, formed on each of the first and second side adapters.

19. The method of claim 15, further comprising: fixing each of the first and second side adapters within the freezer compartment with the side adapters tapering from back to front in order to compensate for a front to rear tapering of the side walls of the freezer compartment such that the first and second extensible drawer slides are arranged substantially parallel to each other.

20. The method of claim 15, further comprising:

attaching basket support plates to respective ones of the first and second extensible drawer slides; and slidably supporting a basket on the basket support plates.

* * * * *